United States Patent [19]

Moret et al.

[11] Patent Number: 4,561,251

[45] Date of Patent: Dec. 31, 1985

[54] HYDRAULIC APPARATUS

[75] Inventors: Michel-Antoine Moret, Geneva; Gérard Cuénoud, Grand-Lancy; Pierre-Jean Jousson, Geneva, all of Switzerland

[73] Assignee: Les Produits Associes LPA SA, Switzerland

[21] Appl. No.: 374,631

[22] Filed: May 4, 1982

[51] Int. Cl.[4] ..... F15B 7/02

[52] U.S. Cl. ..... 60/537; 138/118

[58] Field of Search ..... 60/537; 181/250; 138/118, 124, 125, 26

[56] References Cited

U.S. PATENT DOCUMENTS

| | | | |
|---|---|---|---|
| 2,129,212 | 9/1938 | Hollenback | 60/537 |
| 2,297,046 | 9/1942 | Bourne | 181/250 |
| 3,021,871 | 2/1962 | Rodgers | 138/118 |
| 3,323,305 | 6/1967 | Klees | 138/26 |
| 3,396,812 | 8/1968 | Wilcox | 181/250 |
| 3,548,593 | 12/1970 | Valdespino | 60/537 |
| 3,923,099 | 12/1975 | Brandon | 166/250 X |
| 4,009,734 | 3/1977 | Sullivan | 138/125 |
| 4,276,908 | 7/1981 | Horne | 138/125 |
| 4,306,591 | 12/1981 | Arterburn | 138/125 |

FOREIGN PATENT DOCUMENTS

| | | | |
|---|---|---|---|
| 745924 | 3/1956 | United Kingdom | 60/537 |
| 934942 | 9/1963 | United Kingdom | 60/537 |

*Primary Examiner*—Sheldon J. Richter
*Assistant Examiner*—Randolph A. Smith
*Attorney, Agent, or Firm*—Kane, Dalsimer, Kane, Sullivan and Kurucz

[57] ABSTRACT

A hydraulic apparatus is provided which comprises a liquid-pulse generator, and hydraulic motor connected to said generator by a flexible pipe. The motor is driven by liquid pulses provided by the generator via the pipe. The pulses form standing waves within the pipes with a certain wavelength. In order to insure an efficient energy transfer, the length of the pipe is an odd multiple of the quarter-wavelength.

22 Claims, 5 Drawing Figures

HYDRAULIC APPARATUS

This invention pertains to a hydraulic apparatus, and more particularly a hydraulic apparatus which employs a hydraulic motor.

BACKGROUND OF THE INVENTION

In several fields it has been found desirable to use hydraulic motors for driving certain mechanisms. One such field is the field of Oral Hygiene. In this field, hydraulic motors are superior to electric motors because (1) they can be made out of non-conductive/non-magnetic light materials such as plastics, (2) they do not represent an electric shock hazzard, and (3) they are quieter. Such hydraulic motors, such as the ones described by U.S. Pat. Nos. 3,536,065, 3,489,885, and 3,524,208 comprise an expansible-chamber hydraulic motor "driven by liquid pulses of a liquid through a flexible pipe; said pulses being introduced into the pipe by an appropriate liquid pulse generator. Usually after it expands its energy, the liquid is returned to the source by a separate pipe. However, it has been found in general that such arrangements are very inefficient because the flexible pipes dampen the liquid pulses very drastically and thus the power transmission through these pipes is very poor and unpredictable.

SUMMARY OF THE INVENTION

An objective of this invention is to provide a hydraulic apparatus which makes use of an efficient flexible pipe for transmitting liquid pulses from its pulse generator to the hydraulic motor driven by said pulses. This is accomplished by determining the average length of the standing waves produced by said pulses in the pipes and then providing these pipes with discreet lengths, said lengths being odd multiples of the quarter-wavelengths. The wavelength of the standing waves is a function of the physical characteristics of the pipes.

DESCRIPTION OF THE INVENTION

Figure 1:
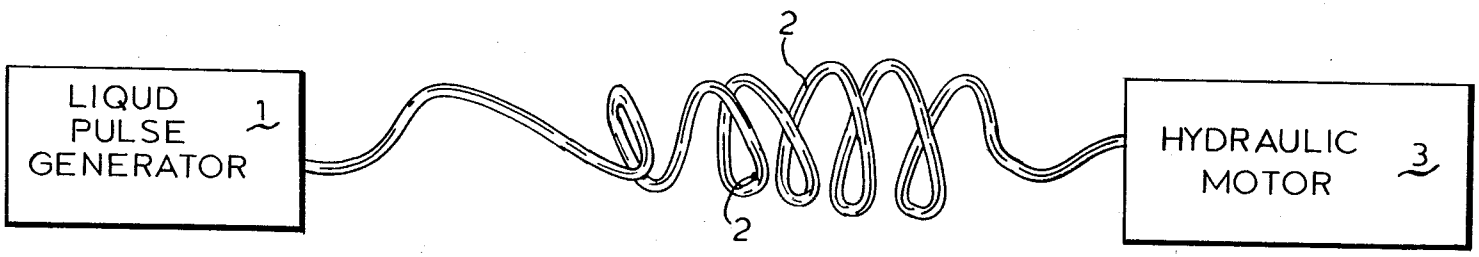
FIG. 1 shows diagramatically the typical elements of the hydraulic apparatus.

As shown in FIG. 1, a hydraulic apparatus, according to this invention comprises a liquid pulse generator 1, a flexible pipe 2, and a hydraulic motor 3.

The liquid pulses transmitted through the pipe can be considered to be standing waves which are characterized at any point x on the pipe by the equation:

$$A^*(x)=A^*p+A^*r=Ap(o)e^{-g^*x}+Ar(o)e^{+g^*x} \quad (1)$$

where the pulse generator is at x=0 and

A*p(x)=the complex magnitude of the progressive wave, for a pipe of length x

A*r(x)=the complex magnitude of the retrograde wave; and g*=the complex propagation constant which, as is given by $$g^*=a+jB$$

Where a is the attenuation coefficient (in Neper or dB per unit length)

B is the phase constant (in radian per unit length) and can be expressed as $$B=W/v$$

Where W is the angular frequency (in rad/sec) of the pulsation and v the propagation velocity (in unit length per second) of the wave within the pipe.

The wave length of the propagation is $$L=\frac{2\pi v}{W}=v/f \quad (2)$$

where f is the frequency of the pulsation.

Figure 2:
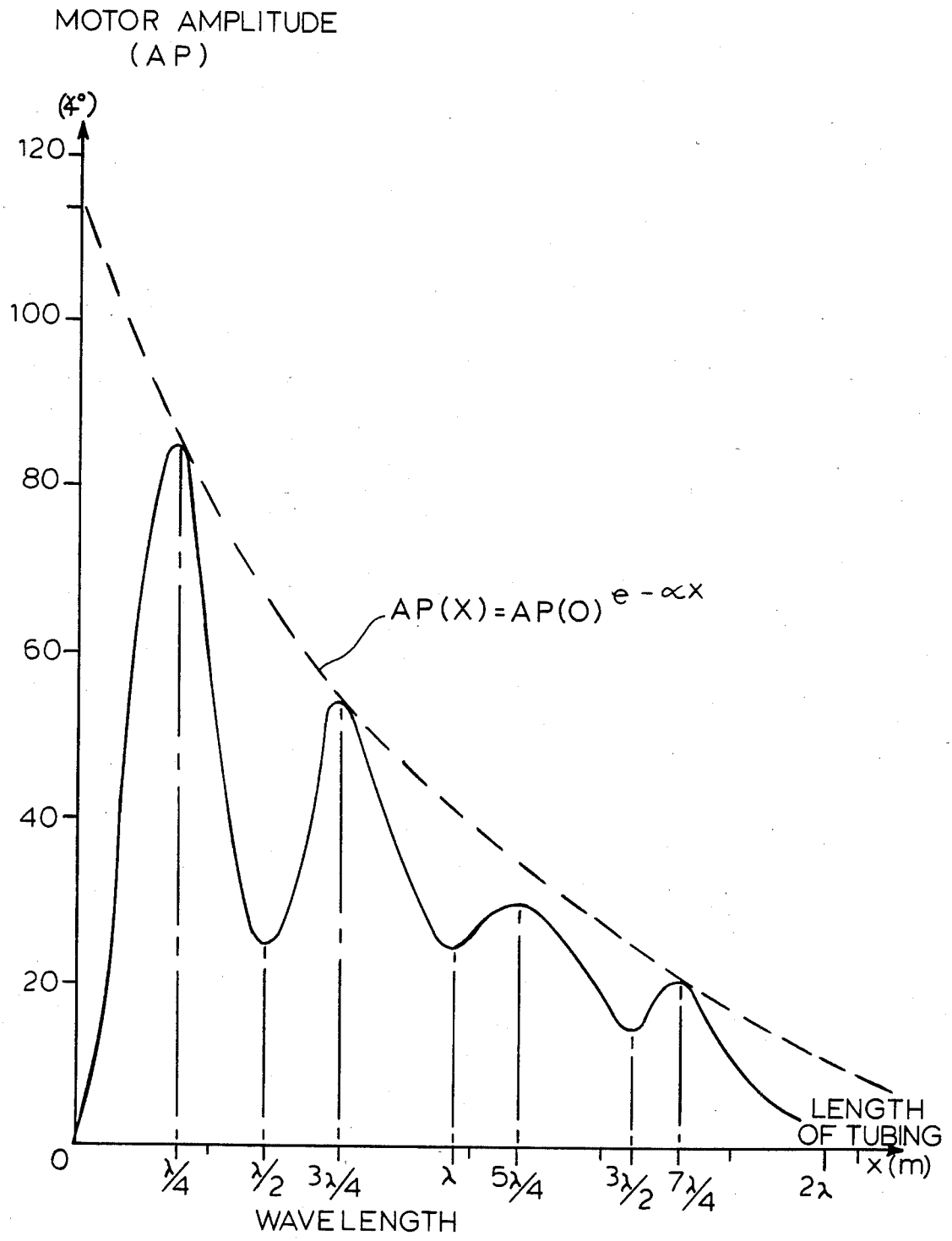
FIG. 2 is a typical graph of the angular motion of a hydraulic motor as a function of the length of pipe connecting the motor to the pulse generator.

FIG. 2 shows a practical case of amplitude distribution along the pipe (with the amplitude being given in degrees and the abscissa representing the length of the pipe in meters) at a frequency of 48.8 Hz. The pipe is made out of polyester elastomer, with an inner diameter of 2.2 mm (and an outer diameter of 3.65 mm). The maxima are located at abscissa equal to odd multiples of L/4 and minima at even multiples of L/4.

In this practical case, the load provided by the hydraulic motor is roughly adapted to the source and the line at each peak, i.e., at each point where the abscissa is equal to an odd number of L/4.

If we consider only the progressive component of the wave, since the retrograde component is generally of less importance we may write:

$$A^*p(x)=A^*p(o)e^{-g^*x} \quad (3)$$

The locus of the peak amplitude is then expressed as follows, using the amplitude attenuation coefficient:

$$Ap(x)=Ap(o)\,e^{-ax} \quad (4)$$

Then:

$$=\frac{-1}{x}\ln\frac{Ap(x)}{Ap(o)} \quad (5)$$

In the example of FIG. 2, the value of is around 0.18 Neper/m or 1.6 dB/m.

The foregoing equations and FIG. 1 shows that the length of the pipe approximately equals to any odd multiples of L/4, 3L/4, 5L/4, 7L/4, etc.

In elastic materials the sound velocity is straight-forward calculated from the Young modulus and the specific mass of the material, as follows:

$$V=\sqrt{\frac{E}{h}}\ (m/s) \quad (6)$$

where

E is the Young modulus in N/m2 h is the specific mass in kg/m3 of the pipe.

In so-called visco-elastic media like rubber and a number of synthetic elastomers as well as thermo-plastic polymers with high molecular weight, it is no longer the case since there is a viscous or damping component.

In other words the static Young modulus does not take into account the dynamic behaviour of the material.

The static Young modulus is given by the slope of a classical stress-strain diagram. As the frequency increases, the strain exhibits a phase delay $\phi$ in regard to the stress. With a sinusoidal stress the stress-strain diagram may be represented by an elliptic loop, the surface of which represents the energy of losses. The Young modulus can then be expressed as a vector rotating at angular frequency W with a phase angle $\phi$. The complex equation of this vector is then:

$$E^* = Eo\,(\cos\phi + j\sin\phi) \tag{7}$$

or $$E^* = Eo\,e^{jo} \tag{7a}$$

Where Eo is:

$$Eo = \frac{dg}{dl/lo} \tag{8}$$

Where dq represents the applied alternating stress in $N/m^2$ dl/lo is the resulting alternating elongation related to the total length.

The value of dq, dl and of the phase angle $\phi$ depend on the frequency and temperature. They also depend but at a lesser degree on the pulsation amplitude. The static strain-stress functioning point has also an influence, (i.e., on the internal static pressure).

Figure 3:
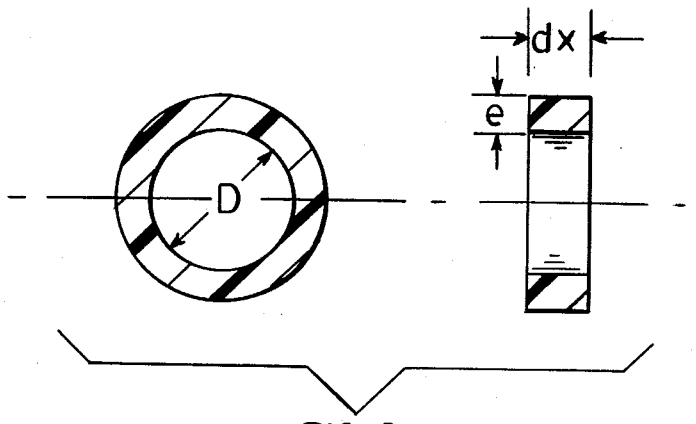
FIG. 3 shows the cross-section of a typical pipe.

The radical dilation of a tube element is determined by the inner pulsating pressure and by the stiffness. The area where deformation effort is applied has the cross section:

$$ds = e\,dx \tag{9}$$

Where e is the thickness of the pipe, dx is a differential sector along its length and D is its inner diameter, as shown in FIG. 3.

The circumference of the tube element which experiences a change is:

$$L = \pi(D+e) \tag{10}$$

The differential stiffness in the pipe element is:

$$dK = \frac{Eds}{L} = \frac{E \cdot e\,dx}{\pi \cdot (D+e)} \tag{11}$$

Where E is the amplitude of the complex Young modulus E* of the pipe, as defined in Equation 7.

It should be noted that the transmission of the wave along the tube depends on the amount of liquid displaced by the pulsating source and by the actual shape taken by the tube along its axis.

The mass of liquid enclosed by the element of FIG. 3 is:

$$dM = c \cdot \frac{\pi \cdot D^2\,dx}{4} \tag{12}$$

Where c is the specific mass of the liquid within the pipe. The radial natural angular velocity of liquid and tube stiffness of the element is then given by:

$$W' = \sqrt{\frac{dK}{dM}} \tag{13}$$

or $$W' = \left(\frac{E\,e\,dx}{\pi\,(D+e)} \cdot \frac{4}{c \cdot \pi D^2\,dx}\right)^{\frac{1}{2}} = \left(\frac{4\,E\,e}{c \cdot \pi^2 D^2\,(D+e)}\right)^{\frac{1}{2}} \tag{14}$$

Since the natural angular frequency of the whole tube is proportional to W', we may write:

$$W = Ko\left(\frac{Ee}{c \cdot D^2\,(D+e)}\right)^{\frac{1}{2}} \tag{15}$$

Where Ko encloses also the constant factors of eq. (14). Replacing eq. (15) in (2) gives:

$$L = \frac{2\,\pi\,v}{Ko}\left(\frac{c \cdot D^2 \cdot (D+e)}{E\,e}\right)^{\frac{1}{2}} \tag{16}$$

which may be rewritten in terms of L/4:

$$L/4 = K_1 \cdot v \cdot \sqrt{\frac{c}{E}}\;D \cdot \sqrt{\frac{D+e}{e}} \tag{17}$$

Knowing that:

$$v = \sqrt{\frac{E}{h}} \tag{6}$$

We have:

$$L/4 = K_1 \cdot \sqrt{\frac{c}{h}} \cdot D \cdot \sqrt{\frac{D+e}{e}} \tag{18}$$

To simplify this relationship, it can be assumed that the various tube materials have the same density, which is around $10^3$ kg/m$^3$ for most plastics and elastomers. Then out comes:

$$L/4 = K2\,D\sqrt{\frac{D+e}{e}} \tag{19}$$

The foregoing analysis reveals that for a given frequency the quarter-wavelength of a given pipe is related to the cross-sectional dimensions of the pipe as shown in equation (19). From equation (2) it is known that the wavelength is inversely porportional to the frequency, therefore eq. (19) may be rewritten as:

$$\frac{L(f)}{4} = \frac{K2'}{f} \cdot D \cdot \sqrt{\frac{D+e}{e}} \cdot (m) \tag{20}$$

A number of tubes of various dimensions and materials have been tested at 48.8 $H_z$ to determine the value of K2. The results obtained are shown in FIG. 4, wherein the vertical axis represents L/4 and the horizontal axis represents $$D \cdot \sqrt{\frac{D+e}{e}}.$$

From this graph it can be seen that:

$$K_2' = 19{,}500.$$

Figure 4:
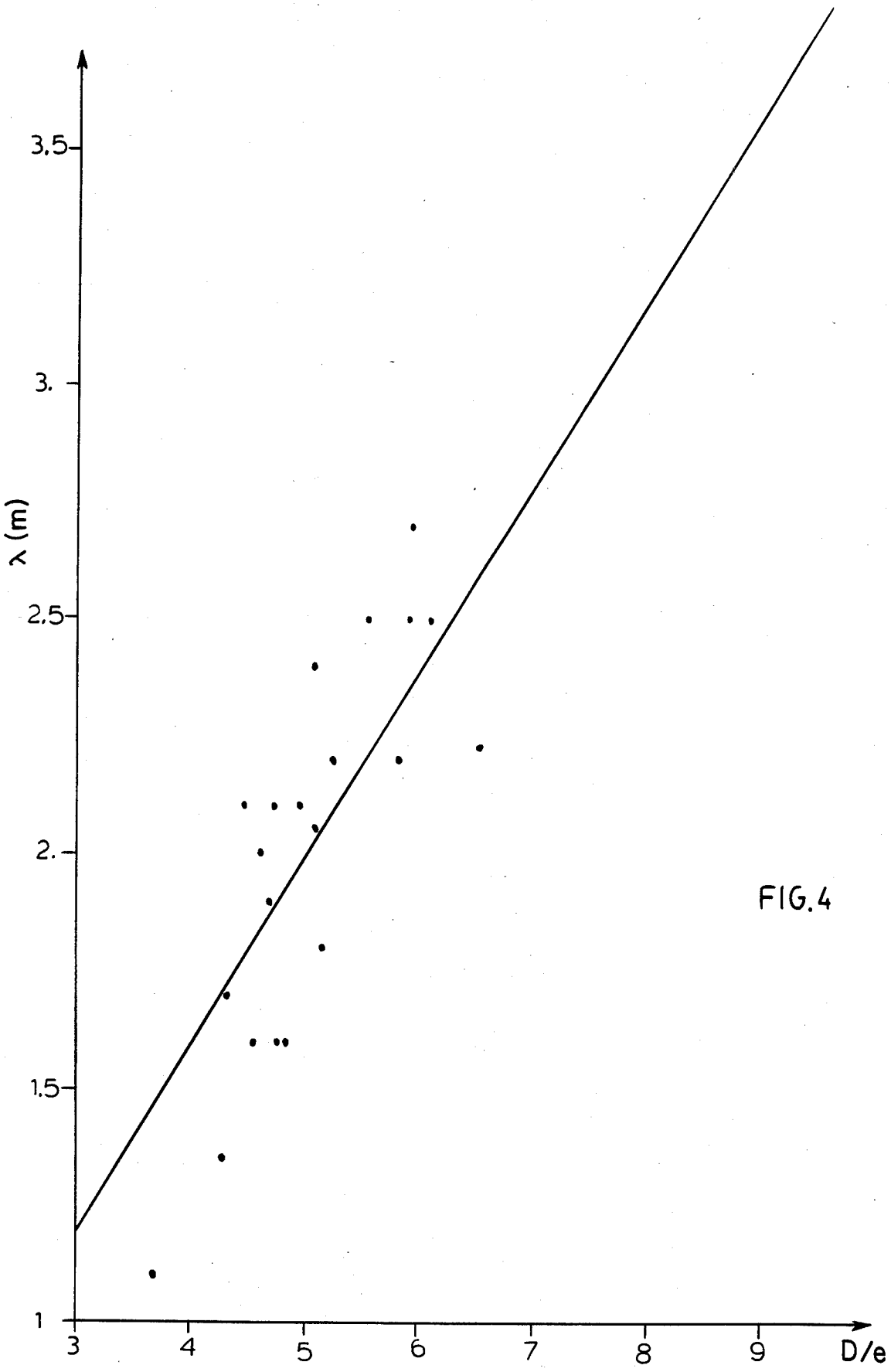
FIG. 4 shows a distribution of the quarter-wavelengths L/4 as a function of the pipe's inner diameter D, and thickness e.

Furthermore, the inventor has found that the data of FIG. 4 is even better approximated by the formula:

$$\frac{L(f)}{4} = \frac{K_3}{f} \cdot \left( D\sqrt{\frac{D+e}{e}} - Do \right)$$

Where Do=2.2 mm and $K_3$=35,650.

The term Do maybe explained by the fact that there is a certain minimum diameter tube below which the pipe may not be connected to the pulse generator and the motor in a manner that would lead to a practical power transmission.

Finally, if the ratio of the pipe's inner diameter to its thickness is assumed to be a constant (which is the case for most commercially available pipes) then equation (20) maybe reduced to:

$$\frac{L(f)}{4} = \frac{K_4}{f}(D - Do') \tag{21}$$

Where Do'=1.350 mm and $K_4$=93,900.

Thus, according to this invention, a hydraulic driving apparatus comprises a liquid pulse generator, a hydraulic motor and a flexible pipe which transmits the liquid pulses from pulse generator to the motor, wherein the length of the pipe is an odd multiple of the quarter-wavelength, said quarter-wavelengths being a function of the frequency of the generated pulses and the cross-sectional dimensions of the pipe.

The inventor has also found that in order to improve the stability and load response of the hydraulic machine, the angular movement of the machine should be limited to $1/\sqrt{2}$ (or 70%) of the amplitude of the standing wave as defined in equation (4) by making the pipe smaller than L/4. (See FIG. 5 where the pipe is smaller for optimal length).

Surprisingly such a limitation also leads to an additional advantage. In addition to driving toothbursches and other similar devices, the hydraulic motors have also been used to direct repetitive jets of water for massaging the dental gums. Inherently, such as application leads to a shift in the wavelengths so that a pipe which has the optimal lengths for a hydraulic machine will deliver less than the optimal spraying force. However, the inventor found that limiting the amplitude of the hydraulic motor as described above, the spraying force is still close to its maximum.

Figure 5:
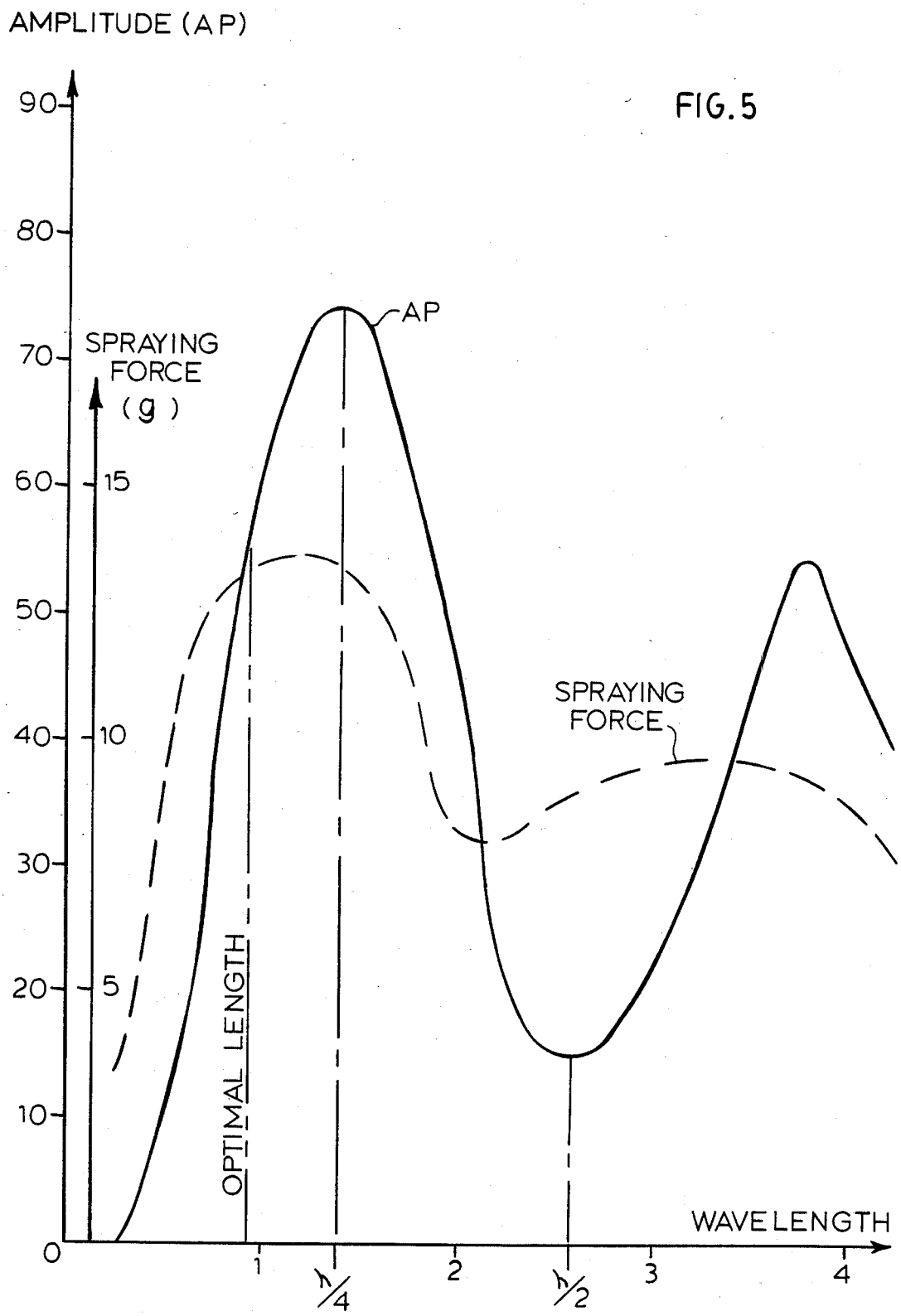
FIG. 5 shows a comparison of the spraying force and motor amplitude as a function of the pipe length.

FIG. 5 is a comparison of the response of the hydraulic motor and the spraying force. It can be seen that at odd multiples of L/4, the spraying force while past its maximum, is still at a high level.

The pipe to be used with the hydraulic apparatus described above can be made of any thermoplastic material having a relatively high molecular weight such as nylon, a polyester elastomer, polyethylene, polyuretane or a re-enforced composite material.

Although theoretically there are no limitations on the size of pipes that can be used, practical considerations lead to the following parameters for pipes:

(1) The inner diameter of the pipe can range from 1.0 to 20.0 mm, but preferably from 2 to 8 mm;

(2) The thickness of the pipe can range from 0.2 mm to 5 mm to 2 mm, but preferably from 0.3 mm to 2 mm.

(3) The length of the pipe can range from 0.2 m to 5 m but preferrably from 0.5 m to 2 m.

Furthermore, the frequency of the pulse generator can range from 10 Hz to 200 Hz but preferably from 20 Hz to 120 Hz.

Normally the pipe is coiled like a spring for easy storage. Naturally, the force necessary to pull away one end of the pipe (connected to the hydraulic motor for example) should be in the range of 0 to 40N, but preferably in the range of 0 to 5N.

I claim:

1. A hydraulic apparatus comprising:

(a) a liquid pulse generator which generates liquid pulses having a wavelength;

(b) a hydraulic machine for transforming the energy of liquid pulses into mechanical energy; and (c) a pipe filled with a liquid and connected at one end to the pulse generator and at a second end to the hydraulic machine to transmit liquid pulses from the pulse generator to the hydraulic machine;

wherein the pipe has a length which is an odd multiple of the quarter-wavelength of the liquid pulses generated by the generator after said generator has reached a steady state condition.

2. The apparatus of claim 1 wherein the pulse generator generates said pulses at a frequency f and wherein the quarter-wavelength L/4 is related to the frequency and to the pipe as follows:

$$L/4 = \frac{K_2'}{f} \cdot D \cdot \sqrt{\frac{D+e}{e}} \text{ (meters)}$$

wherein D and e are the inner diameter and the thickness of the pipe respectively in meters, and $$K_2' = 19{,}500.$$

3. The apparatus of claim 1 wherein the pulse generator generates said pulses at a frequency f and wherein the quarter-wavelength L/4 is related to the frequency and the pipe as follows:

$$L/4 = \frac{K_3}{f}\left( D \cdot \sqrt{\frac{D+e}{e}} - Do \right) \text{ (meters)}$$

where

Do=0.0022 m;

$K_3$=35,650 and D and e are the inner diameter and the thickness of the pipe in meters respectively.

4. The apparatus of claim 1 wherein the pulse generator generates said pulses at a frequency f and wherein the quarter-wavelength L/4 is related to the frequency and the pipe as follows:

$$L/4 = \frac{K_4}{f} \cdot (D - Do') \text{ (meters)}$$

wherein $Do' = 0.00135$ m $K_4 = 93{,}900$ and D is the inner diameter of the pipe in meters.

5. The apparatus of claims 2, 3 or 4, wherein the hydraulic machine has a response which is limited to 70% of its peak amplitude.

6. The apparatus of claim 5 wherein the pipe is made out of a thermoplastic material of the group of materials, said groups comprising nylon, polyester elastomer, polyethylene, polyurethane.

7. A method of making a hydraulic apparatus comprising:

providing a liquid pulse generator which generates liquids pulses having a wavelength;

providing a hydraulic machine for transforming the energy of liquid pulses into mechanical energy; and providing a pipe filled with liquid and having two opposed ends connected respectively to said liquid pulse generator and said hydraulic machine for transmitting liquid pulses, said pipe having a length equal to an odd multiple of the quarter wave length of the liquid pulses generated after said pulse generator has reached a steady state operating condition.

8. The method of claim 7 wherein the pulses have a frequency and wherein the pipe has an inner diameter D and a thickness e, said quarter-wavelength L/4 being determined as follows:

$$L/4 = \frac{K_2^1}{f} \cdot D \cdot \sqrt{\frac{D+e}{e}} \text{ (meters)}$$

where $K_2^1 = 19{,}500$,

D = inner diameter of the pipe, and e = thickness of the pipe.

9. The method of claim 7 wherein the pulses have a frequency f and wherein the pipe has an inner diameter D and a thickness e the quarter-wavelength L/4 being determined as follows:

$$L/4 = \frac{K_3}{f}\left(D \cdot \sqrt{\frac{D+e}{e}} - Do'\right) \text{ (meters)}$$

where $K_3 = 35{,}650$ and $Do' = 0.0022$ meters.

10. The method of claim 7 wherein the pulses have a frequency f and wherein the pipe has an inner diameter D, said quarter-wavelength being determined as follows:

$$L/4 = \frac{K4}{f}(D - Do) \text{ (meters)}$$

where $K4 = 93{,}900$ and $Do = 0.00135$ m.

11. A hydraulic apparatus comprising:

(a) a liquid pulse generator which generates liquid pulses having a wavelength;

(b) a hydraulic machine for transforming the energy of liquid pulses into mechanical energy; and (c) a pipe filled with a liquid and connected at one end to the pulse generator, and at a second end to the hydraulic machine to transmit liquid pulses from the pulse generator to the hydraulic machine;

wherein the pipe has a specific length, said specific length being obtained firstly by determining an optimal length equal to an odd multiple of the quarter-wavelength of the liquid pulses generated by the generator after said generator has reached a steady state condition, which optimum length corresponds to a maximum pulse amplitude at said second end, and said specific length being obtained secondly by reducing said optimum length to a nearest value corresponding to a pulse amplitude approximately equal to 70% of said maximum pulse amplitude said specific length equalling said nearest value.

12. The apparatus of claim 11 wherein the pipe is made out of a re-inforced material.

13. The apparatus of claim 11 wherein the pipe has a length of 0.2 to 5 m.

14. The apparatus of claim 13 wherein the pipe has a length of 0.5 to 2 m.

15. The apparatus of claim 11 wherein the pipe has a thickness of 0.2 to 5 mm.

16. The apparatus of claim 11 wherein the pipe has a thickness of 0.3 to 2 mm.

17. The apparatus of claim 11 wherein the pipe has an inner diameter of 1.0 to 20 mm.

18. The apparatus of claim 17 wherein the pipe has an inner diameter of 2 to 8 mm.

19. The apparatus of claim 11 wherein the frequency ranges from 10 to 200 Hz.

20. The apparatus of claim 19 wherein the frequency ranges from 20 to 120 Hz.

21. The apparatus of claim 11 wherein the pipe is coiled wherein the maximum force necessary to extend the pipe ranges from 0 to 40N.

22. The apparatus of claim 21 wherein the maximum force ranges from 0 to 5N.

* * * * *